US007280638B1

(12) United States Patent
Weaver et al.

(10) Patent No.: US 7,280,638 B1
(45) Date of Patent: Oct. 9, 2007

(54) SYSTEMS, METHODS AND APPARATUS FOR X-RAY TUBE HOUSING

(75) Inventors: Gregory Alan Weaver, South Jordan, UT (US); Lonnie B. Weston, Syracuse, UT (US); David Ellis Barker, Salt Lake City, UT (US)

(73) Assignee: General Electric, Schenectady, NY (US)

( * ) Notice: Subject to any disclaimer, the term of this patent is extended or adjusted under 35 U.S.C. 154(b) by 0 days.

(21) Appl. No.: 11/382,476

(22) Filed: May 9, 2006

(51) Int. Cl.
*H01J 35/10* (2006.01)

(52) U.S. Cl. ..... 378/141; 378/130; 378/200

(58) Field of Classification Search ..... 378/130, 378/141, 144, 199, 200
See application file for complete search history.

(56) References Cited

U.S. PATENT DOCUMENTS 2,900,543 A * 8/1959 Heuse ..... 378/130

6,426,998 B1 * 7/2002 Hell et al. ..... 378/141

FOREIGN PATENT DOCUMENTS

JP 2004-103568 * 4/2004

* cited by examiner

*Primary Examiner*—Jurie Yun
(74) *Attorney, Agent, or Firm*—Peter Vogel; William Baxter; Ellis B. Ramirez

(57) ABSTRACT

An X-ray tube housing with integrated cooling passages in the walls of the X-ray tube housing, through which a liquid or gas coolant is circulated and the heat is transferred from the X-ray tube housing to an external cooler. The integrated cooling passages are created around the perimeter of the X-ray tube housing as the X-ray tube housing is formed. For a rotating anode X-ray tube using an oil coolant, the path of heat transfer is from the anode to the glass insert and oil by the means of radiation. The oil that is in contact with the glass insert conducts heat away form the insert to the X-ray tube housing which is then cooled by the integrated cooling passages located within the X-ray tube housing through which fluid is passed to an external fluid cooling system.

20 Claims, 8 Drawing Sheets

SYSTEMS, METHODS AND APPARATUS FOR X-RAY TUBE HOUSING

FIELD OF THE INVENTION

This invention relates generally to medical imaging systems, and more particularly to cooling of portable of medical imaging devices.

BACKGROUND OF THE INVENTION

Through-put and turnaround of patients is a key economic metric of the productivity of X-ray imaging devices. X-ray imaging devices have a high fixed cost that the owners and operators of the X-ray imaging devices seek to either reduce and/or the owners and operators seek to derive the greatest amount of productivity from the devices, in order to obtain the greatest return-on-investment from the X-ray imaging device.

One way to derive the greatest amount of productivity from the X-ray imaging device is to increase the number of subjects or patients that are imaged in an amount of time. However, the amount of time needed to image a subject is limited to some extent by the amount of time that is required in between imaging sessions to cool the X-ray tube that is in the X-ray imaging device.

An X-ray tube typically converts more than 99% of all the energy supplied to the X-ray tube into heat as an unwanted by-product of producing the desired X-rays. The effective management of X-ray tube heat is a key element in the design of X-ray tube housings.

Improving the transfer of heat energy away from the X-ray tube facilitates increased use of the system and is more efficient for the user since less time is spent waiting for the X-ray tube to cool.

Conventional liquid cooled X-ray tube designs include a pump and a heat exchanger mounted on the X-ray tube. The pump circulates oil from inside the X-ray tube housing through a heat exchanger that cools the oil by either forced air convection or by an external liquid cooler.

Other conventional solutions have incorporated secondary external or internal plumbing lines into the X-ray tube housing, through which a coolant is circulated. The cooling lines typically route the coolant to a radiator near the X-ray tube and a fan cools the plumbing lines in or on the X-ray tube housing.

Mobile X-ray equipment needs to minimize weight and power requirements. Existing cooling solutions have resulted in increased weight and power requirements at the X-ray tube. Any increased weight at the X-ray tube is particularly undesirable due to the counter balancing required for the gantry, and the use of a fan restricts use of the system in some surgical environments.

Conventional X-ray tube housings require a complex design with many parts to integrate the secondary plumbing and customized cooling solutions within the X-ray tube housing which result in high manufacturing and assembly costs.

For the reasons stated above, and for other reasons stated, there is a need in the art for an X-ray tube cooling system that has the weight at the X-ray head. There is also a need to reduce the use of fans at the X-ray tube; to reduce the power requirements at the X-ray tube; and to improve the heat transfer from the X-ray tube housing.

BRIEF DESCRIPTION OF THE INVENTION

The above-mentioned shortcomings, disadvantages, and problems are addressed herein, which will be understood by reading and studying the following specification.

In one aspect, passages are integrated into the walls of the X-ray tube housing, through which a substance having a temperature that is less than the operating temperature of the X-ray tube is circulated, and the heat is transferred from the X-ray tube housing to an external cooler. In some embodiments, the substance is liquid.

In another aspect, the integrated cooling passages are included about the perimeter of the X-ray tube housing as the X-ray tube housing is formed. In some embodiments using a rotating anode X-ray tube and an oil coolant, the path of heat transfer is from the anode to the glass insert and oil by the means of radiation. The oil that is in contact with the glass insert conducts heat away form the insert to the X-ray tube housing which is then cooled by the integrated cooling passages located within the X-ray tube housing through which fluid is passed to an external fluid cooling system.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION OF THE INVENTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical, and other changes may be made without departing from the scope of the embodiments. The following detailed description is, therefore, not to be taken in a limiting sense.

The detailed description is divided into four sections. In the first section, a system level overview is described. In the second section, apparatus of embodiments are described. In the third section, embodiments of methods are described. Finally, in the fourth section, a conclusion of the detailed description is provided.

System Level Overview

Figure 1:
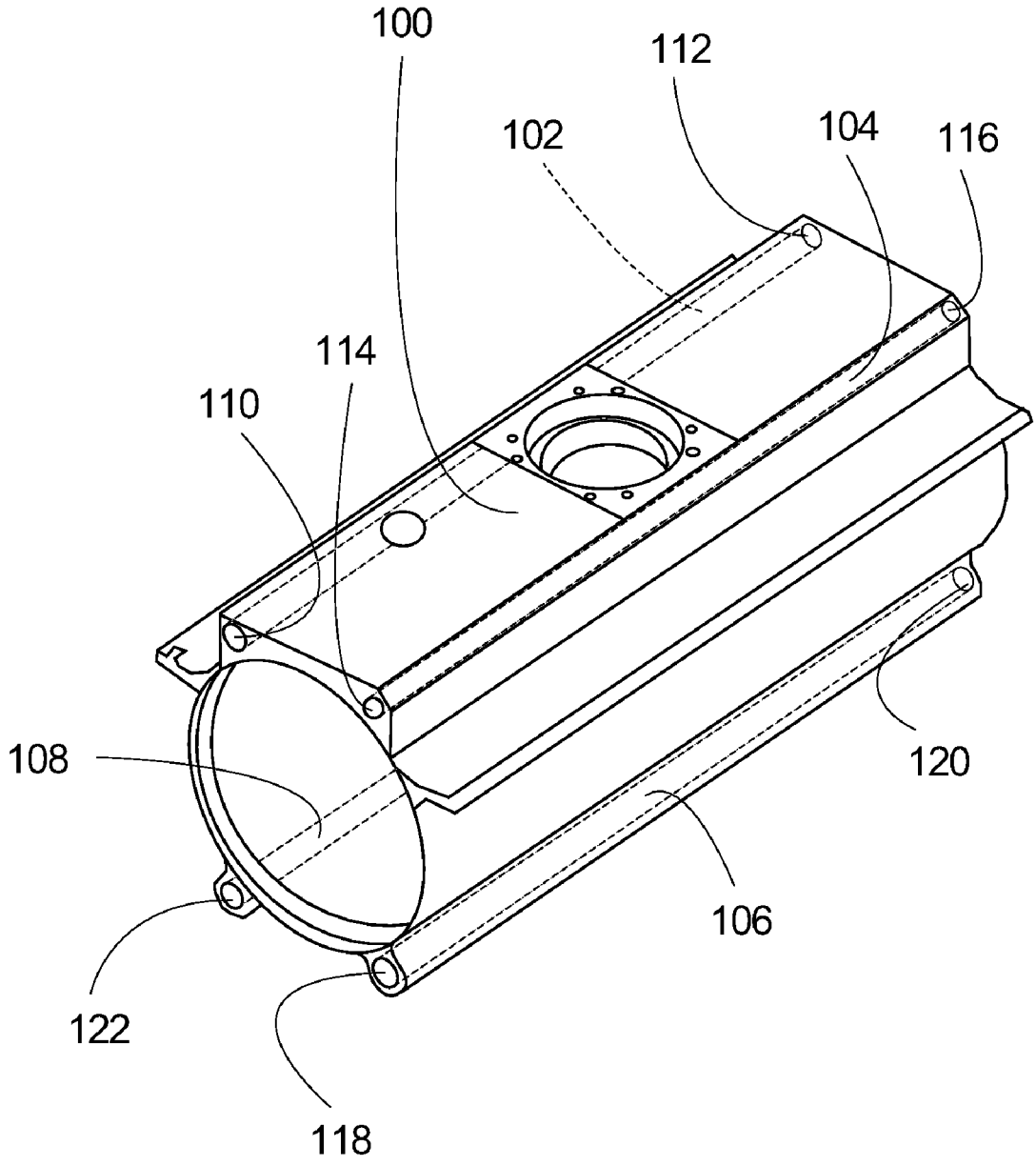
FIG. 1 is an overview diagram of an illustrative X-ray tube housing four coolant passages.

FIG. 1 is an overview diagram of an illustrative X-ray tube housing 100 using four coolant passages 102-108 running through the X-ray tube housing 100. The coolant passage 102 extends from opening 110 to opening 112; coolant passage 104 extends from opening 114 to opening 116; coolant passage 106 extends from opening 118 to opening 120; and coolant passage 108 extends from opening 122. In this illustrative embodiment, X-ray tube housing 100 is manufactured using an extrusion former as a single unit requiring no assembly and obviates mounting secondary plumbing within the X-ray tube housing 100.

By integrating cooling passages 102-108 directly into the walls of the X-ray tube housing 100, a liquid or gas coolant heat exchange can be externally mounted and connected by flexible pipe to the X-ray tube, avoiding excessive weight and power requirements at the X-ray tube and allowing any fan to be safely situated far from the X-ray tube.

Building cooling passages 102-108 directly into the X-ray tube housing 100 allows efficient heat exchange from the internal coolant surrounding the X-ray tube inside the X-ray tube housing 100 to an externally-located liquid or gas coolant heat exchange.

In this illustrative embodiment, cooling passages 102-108 are built into the X-ray tube housing 100 using an extrusion former to enable the manufacture of the X-ray tube housing 100 and cooling passages 102-108 as a single form. The number of cooling passages is limited only by the capability of the extrusion former and the design of the housing.

Integrating the cooling passages 102-108 into the X-ray tube housing 100 simplifies the complexity of the X-ray tube housing assembly by obviating separate secondary plumbing and assists in the external lactation of the heat exchanger. The internal plumbing in this invention is built into the walls of the housing and thus gives the required strength from the metalwork being used to provide the main housing. Integrating plumbing within the X-ray tube housing gives strength to allow the external piping to an external cooling system by increasing the strength of the X-ray tube housing 100 and including the cooling passages 102-108 permits the external mounting of the heat exchanger and cooling system. The X-ray tube housing 100 also obviates mounting a cooling fan at the X-ray tube that allows the use in more surgical environments.

The X-ray tube housing 100, by integrating coolant passages 102-108, also obviates many separate cooling parts within the X-ray tube housing, thereby lowering assembly cost by removing the requirement for additional pipework that needs to be separately manufactured. Not only is the additional miniature pipework not required, but the required mounting problems are avoided and the corresponding assembly issues previously involved in connecting the pipework to the external cooler are eliminated because the housing already contains the pipe within the single piece.

The X-ray tube housing 100 also solves the need in the art to mount the cooling unit directly at the X-ray tube and allows the use of an external cooler not on the gantry holding the X-ray tube, thus reducing the weight of that cooler and removing the need for additional power lines to the X-ray tube housing. The integration of the coolant pipes into the housing avoids the need to minimize stress upon that pipework because the housing itself provides the superior strength such that any torque applied at the connection point to the external cooler can be distributed across the entire housing. This resistance to torque allows the use of external tubing, which will exert such force, whereas the prior art use of internal, discrete, piping would place all such torque upon the mounting point which would not be able to withstand the strain and thus require the use of a cooling unit directly attached to the X-ray tube housing.

While the integration of the cooling passages 102-108 into the X-ray tube housing 100 is not limited to any particular number of coolant passages, for sake of clarity a simplified design using four passages is described. Depending upon the competing requirements of the strength, weight, and coolant flow any number of passages could be used from a single larger passage with high coolant flow through to a large number of passages that would allow more uniform heat dissipation.

Apparatus Embodiments

Figure 2:
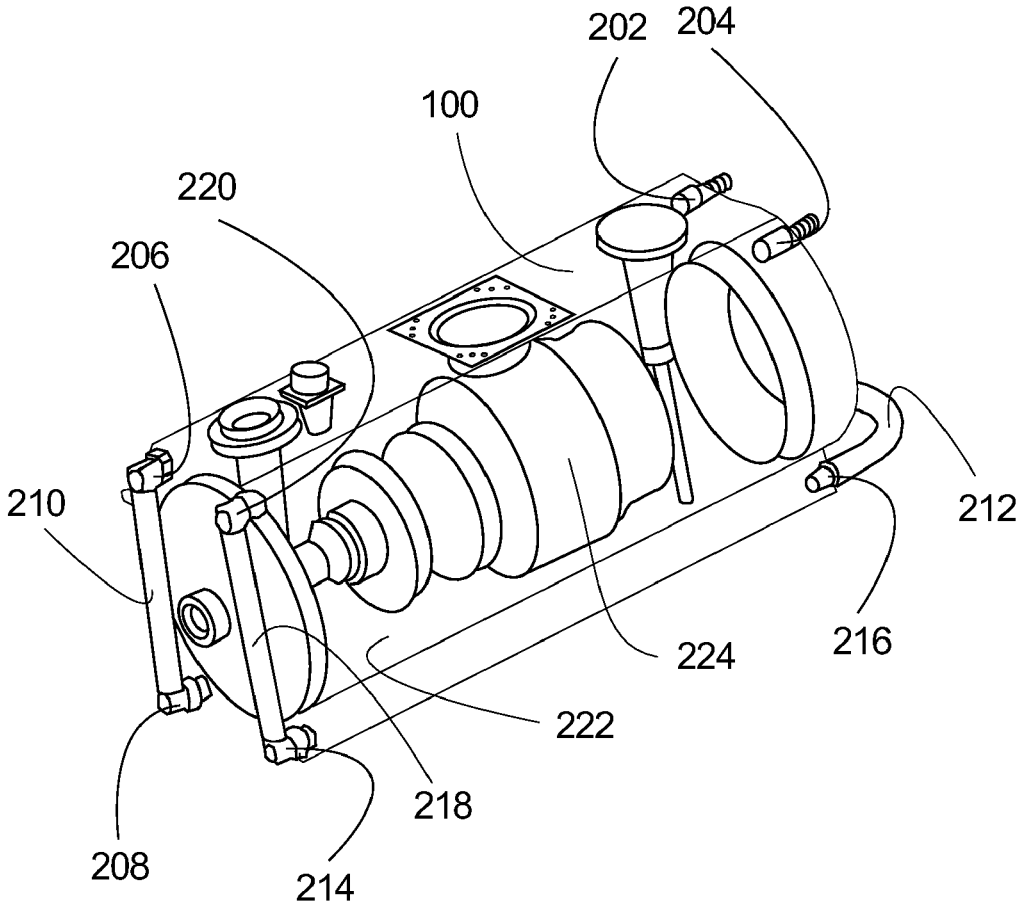
FIG. 2 is a diagram of an illustrative X-ray tube housing showing the connections between coolant passages, an illustrative X-ray tube mounted within, and the connections to the external cooler.

FIG. 2 is a diagram of X-ray tube 100 housing showing the connections between coolant passages, an illustrative X-ray tube mounted within, and the connections to the external cooling unit. The X-ray tube housing 100 is connected to the external cooling unit through fittings 202 and 204 in openings 112 (FIG. 1) and 116, respectively.

Openings 110 and 122 are coupled to one another through fittings 206 (FIG. 2) and 208 and a pipe 210 coupled there between. A pipe 212 connects an opening at the hidden end of coolant passage 108 (FIG. 1) to opening 202 at a fitting 216 (FIG. 2). A pipe 218 couples fittings 214 and 220 to thereby couple opening 118 (FIG. 1) to opening 114.

Flow within the X-ray tube housing 100 is directed as follows: coolant from an externally located coolant heat exchange (i) enters through fitting 202; (ii) passes through fitting 116 and though coolant passage 102; (iii) passes through fitting 206, pipe 210, and fitting 208 to coolant passage 108; (iv) through coolant passage 108, pipe 212, and fitting 106 to coolant passage 106; (v) through coolant passage 106, fitting 214, pipe 218, and fitting 220 into coolant passage 104; and (vi) out fitting 204 to the externally located heat exchange.

In an alternative embodiment, the flow of coolant through the X-ray tube housing 100 is in the opposite direction. Within the X-ray tube housing 100 is sealed the primary coolant 222 which is oil in this illustration. The actual X-ray tube 224 is mounted within the X-ray tube housing 100 in a conventional manner.

Figure 3:
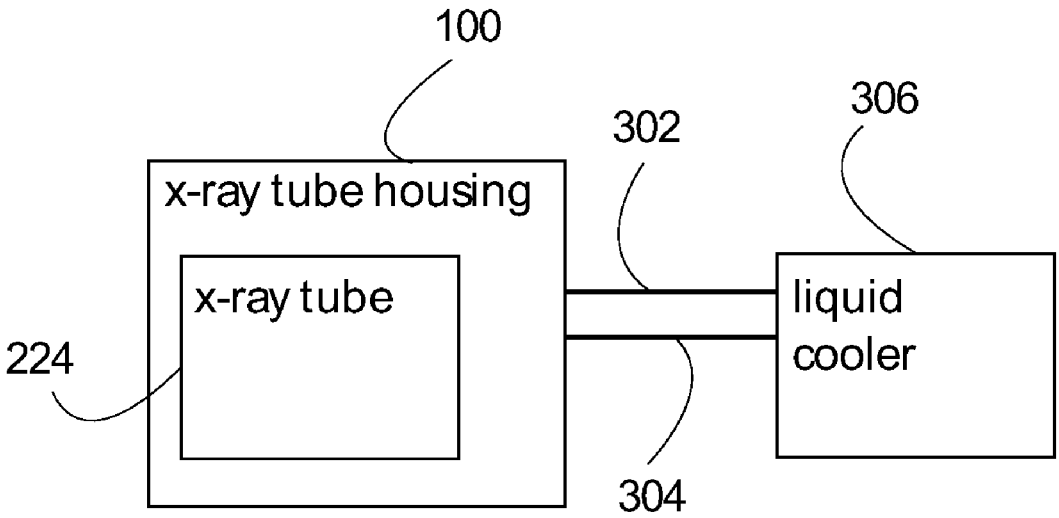
FIG. 3 is a conceptual diagram of the new method of cooling the X-ray tube.

FIG. 3 is a block diagram of the new method of cooling the X-ray tube. The X-ray tube housing 100 contains the X-ray tube 224 but is created with integral cooling passages that are attached by external lines 302 and 304 to an external coolant heat exchange 306.

Figure 4:
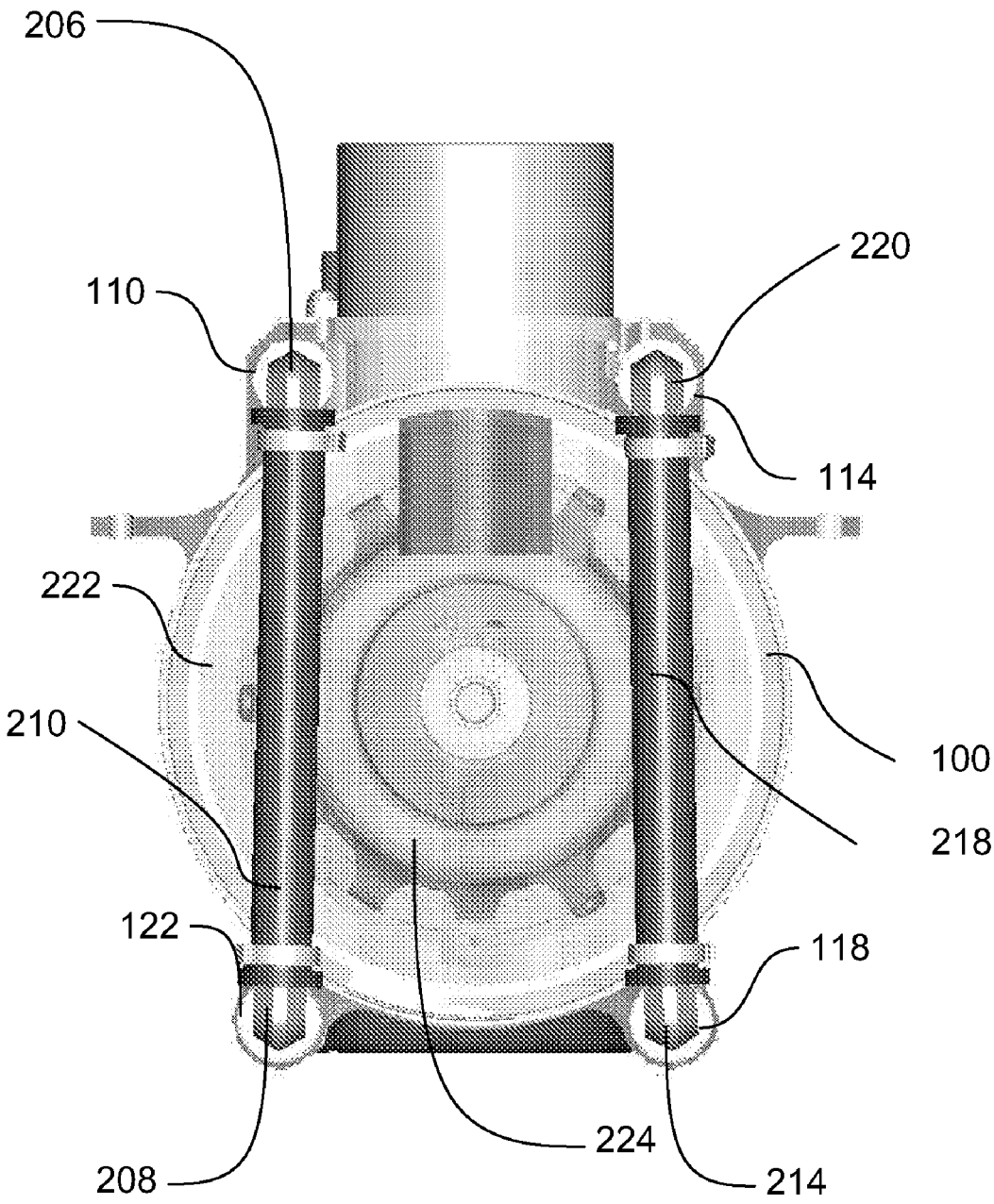
FIG. 4 is a diagram of an illustrative end-view of an X-ray tube housing showing the connections between coolant passages, an illustrative X-ray tube mounted within, and the connections to the external cooler.

FIG. 4 is a diagram of an illustrative end-view of an X-ray tube housing showing the connections between coolant passages, an illustrative X-ray tube mounted within, and the connections to the external cooler.

Figure 5:
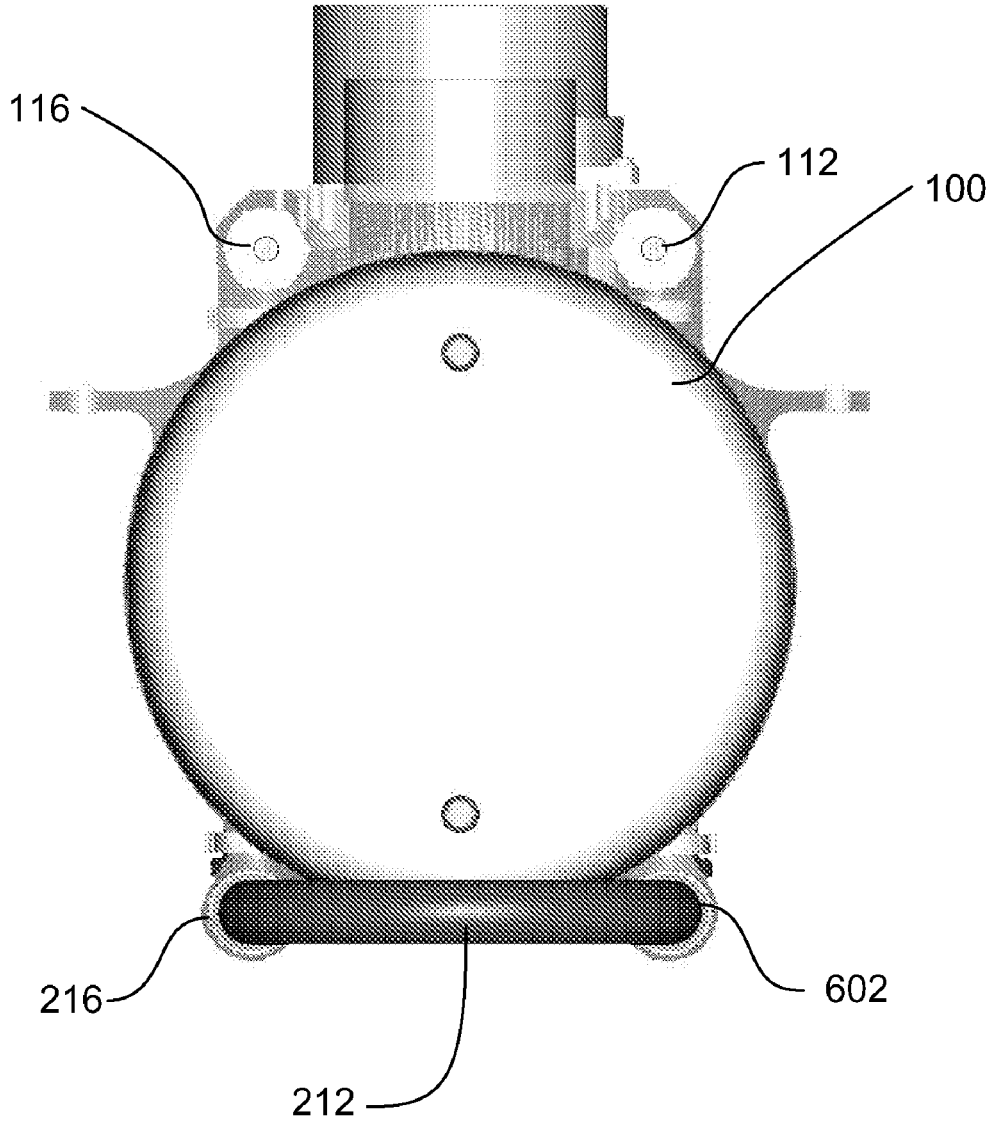
FIG. 5 is a diagram of an illustrative end-view of an X-ray tube housing.

FIG. 5 is a diagram of an illustrative end-view of an X-ray tube housing.

Figure 6:
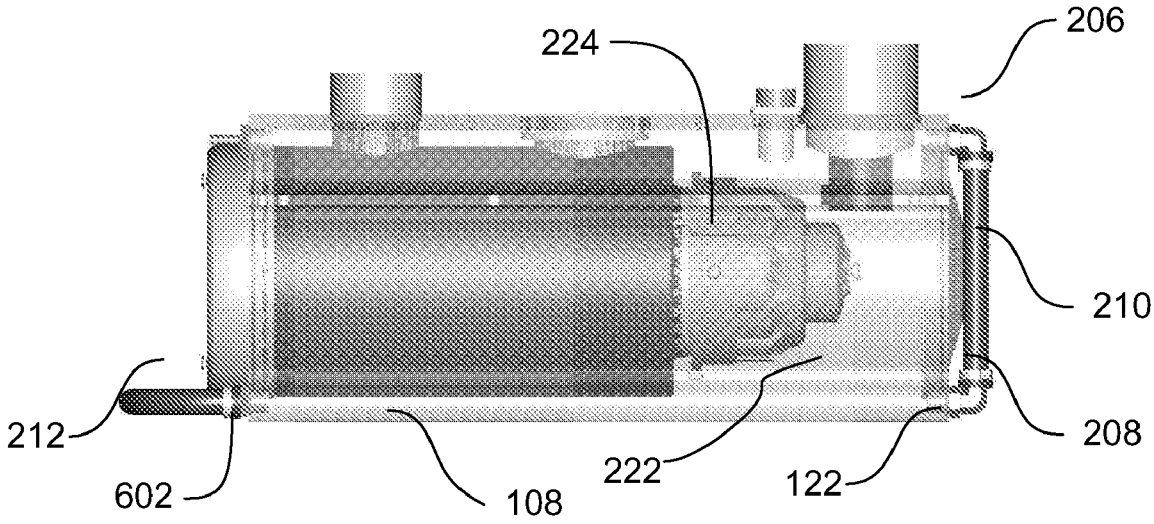
FIG. 6 is a diagram of an illustrative side-view of an X-ray tube housing showing the connections between coolant passages, an illustrative X-ray tube mounted within, and the connections to the external cooler.

FIG. 6 is a diagram of an illustrative side-view of an X-ray tube housing showing the connections between coolant passages, an illustrative X-ray tube mounted within, and the connections to the external cooler.

Figure 7:
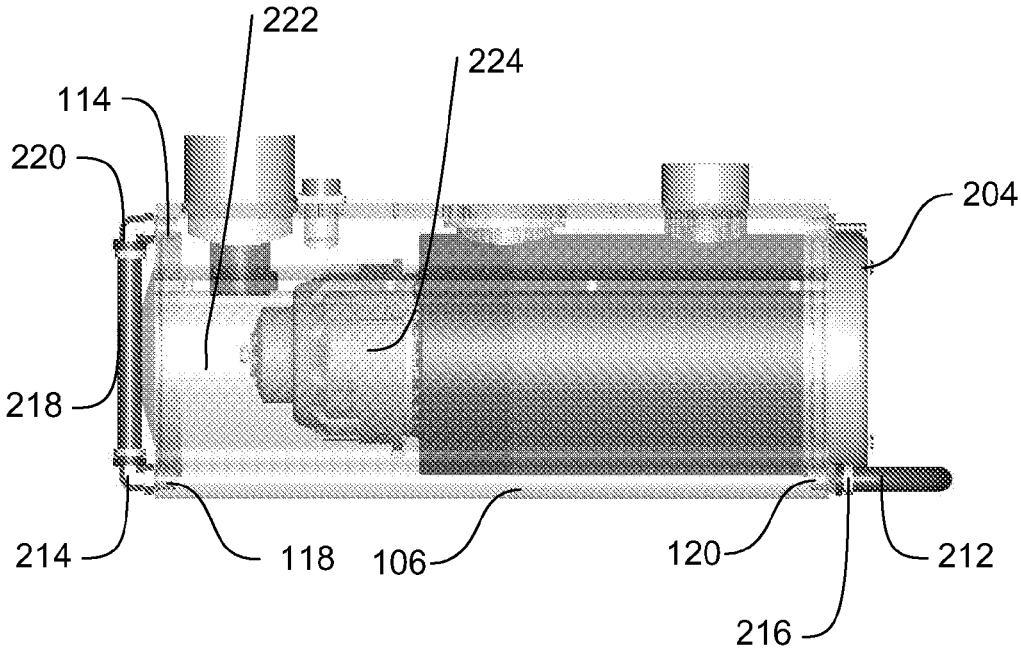
FIG. 7 is a diagram of an illustrative side-view of an X-ray tube housing showing the connections between coolant passages, an illustrative X-ray tube mounted within, and the connections to the external cooler.

FIG. 7 is a diagram of an illustrative side-view of an X-ray tube housing showing the connections between coolant passages, an illustrative X-ray tube mounted within, and the connections to the external cooler.

Method Embodiments

In the previous section, embodiments of apparatus are described. In this section, embodiments of methods are described.

Figure 8:
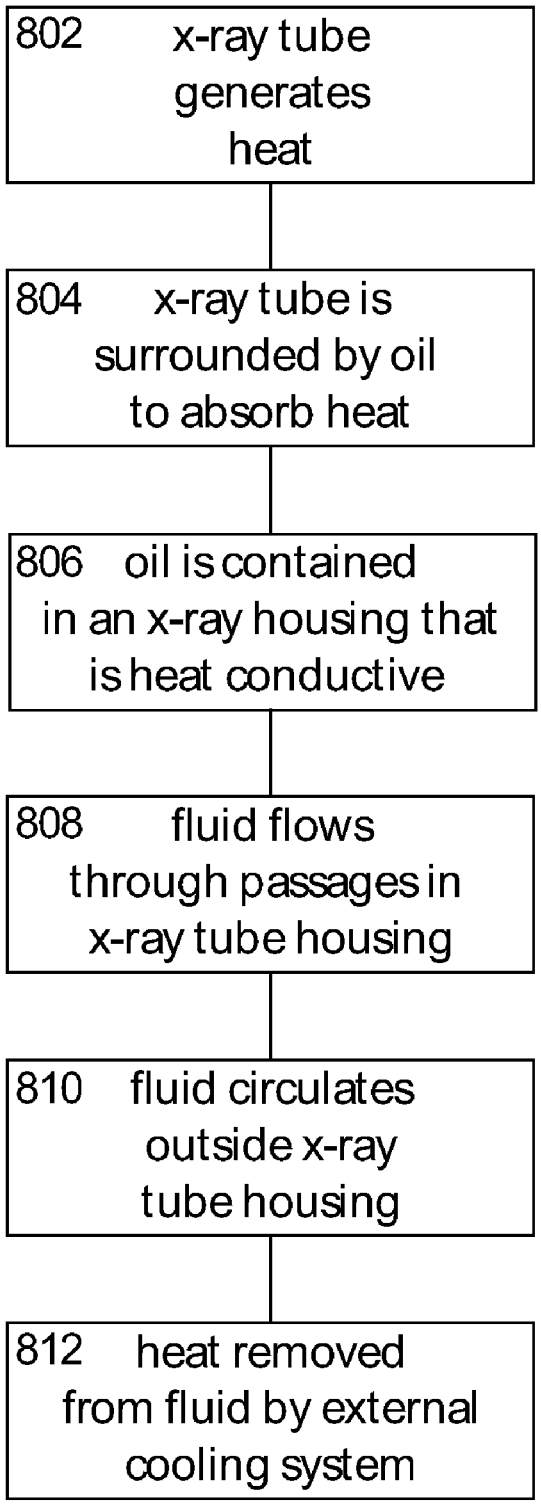
FIG. 8 is a flowchart showing the movement of heat through the system.

FIG. 8 is a flowchart showing an illustrative flow of heat through the system when using a rotating anode X-ray tube using an oil coolant. Unwanted heat is generated by the X-ray tube 802 which in the illustrative embodiment is surrounded by oil to absorb that heat 804; the oil is contained in an X-ray housing that is heat conductive 806 and is cooled by coolant fluid caused to flow through one or more passages in the X-ray housing 808; the fluid circulates outside the X-ray tube housing 810 and is removed from the fluid by an external cooling system 812.

CONCLUSION

An X-ray tube housing with integrated cooling passages is described. Although specific embodiments are illustrated and described herein, any arrangement that is calculated to achieve the same purpose may be substituted for the specific embodiments shown. This application is intended to cover any adaptations or variations. For example, although described as using four cooling passages within the X-ray tube housing, implementations can be made using 1, 2, 6, 8, or any other number of cooling passages that provides the required function.

In particular, the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments. Embodiments are applicable to future imaging devices, different medical devices, and new examination equipment.

The terminology used in this application with respect to X-ray tube housing tubes is meant to include all imaging housings and secondary cooling environments and alternate technologies which provide the same functionality as described herein.

We claim:

1. An apparatus comprising:

an extrusion former housing having at least one wall for containing an X-ray tube; and at least one internal cooling passage formed in the at least one wall of the extrusion former housing for absorbing heat generated by the X-ray tube;

wherein the at least one internal cooling passage and the extrusion former housing is a single form.

2. The apparatus of claim 1, wherein the at least one wall further comprises an encasing structure defining an X-ray tube containment area within the apparatus and in which the at least one internal cooling passage is defined; and wherein the apparatus further comprises at least one fitting attached to at least one end of at least one of the internal cooling passages to direct coolant into and through the internal cooling passage.

3. The apparatus of claim 2 wherein the encasing structure has a first end and a second end;

wherein at least two fittings further comprises:

a first fitting attached to one of the at least one internal cooling passage at the first end to direct coolant into and through the internal cooling passage; and a second fitting attached to the same internal cooling passage at the opposite end from the first end to receive coolant passing through and out of the same internal cooling passage.

4. The apparatus of claim 3 wherein the at least one internal cooling passage is interconnected such that coolant directed through the first fitting passes through the first internal cooling passage and through a second internal cooling passage to pass through the second fitting.

5. The apparatus of claim 3 further comprising:

a first flexible tubing attached to the first fitting;

a coolant heat exchange attached to the first flexible tubing;

a second flexible tubing attached to the coolant heat exchange, to circulate coolant between the extrusion former housing and the coolant heat exchange.

6. The apparatus of claim 1 wherein the at least one internal cooling passage further comprises:

an even number of internal cooling passages.

7. The apparatus of claim 1 wherein the at least one internal cooling passage further comprises:

four internal cooling passages.

8. The apparatus claim 1 further comprising:

an X-ray tube attached to and located within the extrusion former housing;

a flexible pipe attached at a first end to the extrusion former housing; and an external liquid or gas cooler attached to a second end of the flexible pipe.

9. An X-ray assembly comprising:

an extrusion former housing having an X-ray tube containment area;

at least one passage formed spanning a perimeter of the extrusion former housing;

an X-ray tube positioned within the X-ray tube containment area of the extrusion former housing and attached to the extrusion former housing; and wherein the extrusion former housing and the at least one passage is a single form.

10. The X-ray assembly of claim 9 further comprising:

a primary coolant surrounding the X-ray tube in the X-ray tube containment area of the extrusion former housing.

11. The X-ray assembly of claim 10 wherein:

the primary coolant comprises oil.

12. The X-ray assembly of claim 10 wherein the extrusion former housing isolates the primary coolant from the X-ray tube in the X-ray tube containment area.

13. The X-ray assembly of claim 9, wherein the X-ray tube further comprises:

the X-ray tube being mounted within the extrusion former housing in a primary coolant.

14. The X-ray assembly of claim 9, wherein the extrusion former housing is:

connected by flexible piping to an external liquid or gas cooler.

15. A method to cool an X-ray tube in an extrusion former housings comprising:

installing a plurality of cooling passages in walls of the extrusion former housing, wherein the extrusion former housing has an X-ray tube containment area; and employing an external liquid or gas cooler external to the extrusion former housing to dissipate heat;

wherein the extrusion former housing and the plurality of cooling passages is a single form.

16. The method of claim 15, wherein the plurality of cooling passages are:

connected to an external cooler.

17. The method of claim 15, wherein the plurality of cooling passages connected to an external cooler by a flexible piping.

18. The method of claim 15 further comprising:

circulating liquid or gas by an external cooler to cool the plurality of cooling passages.

19. The method of claim 15 further comprising:

cooling a primary coolant within the extrusion former housing by heat transference to the extrusion former housing.

20. The method of claim 15 further comprising:

dissipating heat created by the X-ray tube through a primary coolant into the extrusion former housing.

* * * * *